United States Patent [19]

Caruso

[11] Patent Number: 4,515,083

[45] Date of Patent: May 7, 1985

[54] ANTI-PERSONNEL FRAGMENTATION LINER

[76] Inventor: Anthony M. Caruso, 1620 Dallas St., Aurora, Colo. 80010

[21] Appl. No.: 461,509

[22] Filed: Jan. 27, 1983

[51] Int. Cl.[3] ..... F42B 27/00; F42B 13/48

[52] U.S. Cl. ..... 102/493; 102/482

[58] Field of Search ..... 102/482, 493, 491, 492, 102/494, 495

[56] References Cited

U.S. PATENT DOCUMENTS 2,023,158 12/1935 Williams ..... 102/482

*Primary Examiner*—Charles T. Jordan

*Assistant Examiner*—Ted L. Parr

*Attorney, Agent, or Firm*—Charles E. Baxley

[57] ABSTRACT

Illustrative embodiments of the invention are directed to a fragmentation casing for a munition in which the size and distribution pattern of the shrapnel is carefully controlled. Typically, the casing is formed from a stacked array of rings in which angularly oriented inner and outer surface grooves form apertures at the mutual intersections. Through control of ring size, groove depth and shape, a light-weight, efficient fragmentation casing is provided in which the size, shape and bursting pattern of the resulting shrapnel is regulated in a predetermined manner.

6 Claims, 5 Drawing Figures

ANTI-PERSONNEL FRAGMENTATION LINER

This invention relates to improvements in anti-personnel weapons and, more particularly, to controlled grooves in the casing of a fragmentation munition to regulate the size, weight and effective radius of the resulting shrapnel, and the like.

Anti-personnel weapons are subject to a number of conflicting needs. Unquestionably, anti-personnel weapons should disintegrate into individual fragments, or shrapnel, of such shape that maximum damage is inflicted to human flesh. For reasons considered subsequently in more detail, and particularly with respect to hand grenades, these fragments also should enjoy shapes that will permit air resistance to dissipate fragment energies in short distances in order to render the fragments harmless at some predetermined distance beyond the point of explosion that produced the fragments in question. Naturally, adaptability to assembly into a complete munition is a further manufacturing consideration that must be taken into account in the development of a satisfactory anti-personnel weapon.

Clearly, these requirements have been the subject of considerable study and development for many years.

With respect to the effective radius of the fragments, hand grenades constitute a hazard to the person throwing them unless they are thrown from prepared positions. Because of this hazard, the North Atlantic Treaty Organization, (NATO), has expressed the idea that hand grenades should be lethal within five meters of the bursting point, yet inoffensive at 20 to 25 meters. Various ways have been tried to satisfy this need but none of these attempts fully meet the requirements.

The Germans produce plastic bodied grenades. In the grenade interior, cast integrally with the explosive charge, are several thousand steel spheres of small diameter. While this grenade is lethal at the 5 meter distance, some spheres reach as far as 80 meters. In the United States and Great Britain a thin walled sheet metal casing encloses a coil of thin wire that is an ovoid spring with closed spirals to form a liner. At definite small intervals the wire is scored. The explosive charge, moreover, is internal to the coil. It is believed, in these circumstances that the explosion will break the wire at the scoring to produce individual fragments of small size. In practice, however, breaks at each score do not result and many fragments, instead of being single are multiples. These multiples have greater mass and consequently travel further to become lethal beyond the desired distance from the bursting point.

In Italy, experiments have been conducted with plastic bodied grenades in which individual fragments are shaped to have negative aerodynamics by cementing the fragments in a thin layer to the internal surface of the grenade body or outer casing and then loading the interior of the casing with the explosive charge.

Although this last method produces the desired results, millions of fragments of suitable aerodynamic shape must be manufactured because each grenade contains approximately 1000 fragments. And finally, each fragment must be cemented in place in what is presumably, a laborious, difficult and expensive manufacturing procedure.

It has been determined that in order to achieve these desired aims, it is necessary to have fragments of as low a mass as possible and to impart to them as high an initial velocity as possible. High velocity is achieved by having a high ratio of brisant explosive to mass of fragments and to shape these fragments so that air resistance will rapidly deplete the fragment energy.

Therefore high initial fragment velocity will produce lethality at close range and the fragment mass and high air resistance will dissipate energy at the longer ranges.

Attention is invited to additional considerations. Artillery and mortar projectiles, bombs, land mines, hand grenades and similar munitions are high density devices and hence exhibit extremely heavy unit weights. Naturally, reductions in these unit weights are quite desirable in order to achieve efficiencies in shipment, handling and actual delivery to the target. Weight reductions in these munitions, however, most often are achieved through decreases in the size of the bursting charge and the weight of the fragmentation casing. In these circumstances efficiences in transportation and handling are attained only at the cost of a marked decrease in the effectiveness of the weapon.

The modern hand grenade, for example, typifies many of these dilemmas in munition design. For example, hand grenades should be light in weight in order to avoid unnecessarily burdening combat personnel. Reduce the weight and the grenade loses its lethality because a lighter fragmentation casing and a smaller bursting charge are less likely to produce a suitable distribution of shrapnel with appropriate impact effect. Better regulation of the shape and mass of the fragments in order to control more closely the effective range and the result on fragment impact is clearly desirable, but, as noted above with respect to Italian grenades, have been attained only through the adoption of costly and time consuming manufacturing procedures.

In the past it was common to cast the outer fragmentation casing for hand grenades from heavy cast iron. Usually these casings had segmented outer surfaces that somewhat resembled small pineapples. The grooves between the segments were expected to form fracture lines when the charge within the casing exploded in order to produce shrapnel of predetermined shape, mass and distribution or dispersion. The results frequently were less than desirable. Depending upon the quality of the particular casting, the case might fragment in a uniform pattern of shrapnel of suitable mass. If the casting was in any way defective, however, the casing might burst along only one groove. In this latter instance, the grenade produced only a loud noise and either no shrapnel or a very irregular pattern of shrapnel distribution, thus failing completely in its purpose.

This problem could be overcome, if at all, through costly and careful inspection of each cast iron case before it was filled with bursting charge and detonator.

Accordingly, the need still exists to provide lighter, less expensive munitions without compromising the effectiveness of these weapons. Better control over fragment shape, mass and dispersion patterns also is needed. As these problems relate to the hand grenade, moreover, there remains a further need for greater lethality at close range and greater safety at longer range.

These problems are solved, to a large extent, through the practice of the invention. The munition liner that characterizes the invention produces fragments that offer suitable air resistance and which would be very difficult to manufacture individually. The liner, as applied to hand grenades, may be fabricated of a material that is less dense than steel, e.g. hard anodized aluminum, titanium, ceramic material and the like.

A typical munition fragmentation casing that embodies principles of the invention is formed through a stacked array of rings. One transverse surface of each of these rings has at least one deep groove. The opposite surface of each of these rings has an array of grooves formed in its own surface. The grooves in this array are angularly disposed relative to the groove (or grooves) on the other surface of the ring. By varying the number of grooves, their respective depths and angular orientations the size, shape, mass and dispersion pattern of the resulting shrapnel can be carefully controlled.

Through careful control of the depths of the grooves on opposite sides of the rings, apertures, or holes, can be formed in the ring structure at mutual groove intersections. As the munition is filled with explosive, a limited amount of the explosive will flow thorugh the apertures and fill the volumes formed between the outer grooves and the munition casing. As a consequence, the explosion, occurring on both sides of the fragmentation liner, insures that the liner will break up into the individual fragments of predetermined size and shape.

Further, the grooves promote sharp apices of fragmentation material that are characterized by high stress concentrations together with weak metal bonds. This compels the fragmentation liner to break into individual fragments and not into clusters. The stress concentrations at the apices, moreover, can be even further increased through heat treatment, e.g. rapid quenching after heating.

The grooves from which the apices are developed form a grid which can be shaped to suit specific requirements in which, for instance, lighter weight fragments of greater mass and volume than that which heretofore had been possible in mass production munitions are now available.

The sharp-pointed apices that typify the embodiment of the invention under consideration are clearly more effective upon impact and are superior to the spherical or cylindrical fragments that have characterized much of the prior art.

These rings, as mentioned above, can be manufactured from hard anodized aluminum in order to produce suitably large, low weight fragments. In this way, the resulting large fragments are subject to greater air resistance. These large fragments produce improved effectiveness at close range while, for hand grenades, providing better safety to the person who threw the grenade from a greater distance because air resistance more rapidly dissipates the energy of these larger, lighter fragments thereby reducing the effective radius of the burst.

Because the fragmentation casing is assembled from individual rings there is much greater flexibility in arranging these rings to achieve a desired shrapnel pattern. These rings are also more readily inspected and at lower cost than a single, massive cast iron casing. A manufacturing defect in any one ring leads only to a failure in that ring when the bursting charge is exploded, in contrast to a defective monolithic case in which a flaw in the casting is likely to produce an entirely ineffective weapon.

The use of anodized aluminum in accordance with the invention and the superior fragmentation control that this invention provides further permit the use of munitions with lighter unit weights but of unimpaired effectiveness.

To summarize, a liner according to the principles of the invention is easier to manufacture than single fragments cemented to the inside of a casing or the scored wire coil.

The fragments produced through a liner of the type under consideration have (to better dissipate force imparted in the explosion) poor aerodynamic coefficients. These fragments also enjoy superior impact effect and the desired fragment shape is readily obtained.

Although the liner may be formed of dense ferrous material for some applications (mortar and artillery projectiles, for instance), for individual munitions, of which the hand or rifle grenade is typical, non-ferrous materials of lower specific weight can be used to reduce the unit weight of the particular munition without impairing its effectiveness.

By filling all of the grooves in the liner, both inside and outside, the explosive forces bearing against all of the groove surfaces generate respective resultant forces that concentrate at each of the fragment apices. These resultant forces thereby enhance the possibility of complete liner disintegration into individual fragments, rather than clusters.

The insertion of a one piece liner into a casing is a relatively inexpensive process, in contrast with the Italian system of cementing individual fragments to the inside of a casing.

Munition casing weight also can be reduced. Plastics or other low density materials now can be substituted for the relatively thick steel or cast iron casings that heretofore had been required and, which, more dense materials, generally failed to burst into the desired more-or-less uniform fragments.

Consequently, the invention permits the creation of fragments of predetermined shape, which shape (or shapes) can be quite complicated, with ease and at low cost. Complete and uniform fragmentation now also is possible because of the presence of an explosive charge on both sides of the fragmentation liner.

These other advantages of the invention are more completely described in the following detailed description when taken in conjunction with the accompanying drawing. The scope of the invention is nevertheless limited only by the appended claims.

DETAILED DESCRIPTION OF THE PREFERRED EMBODIMENTS

Figure 1:
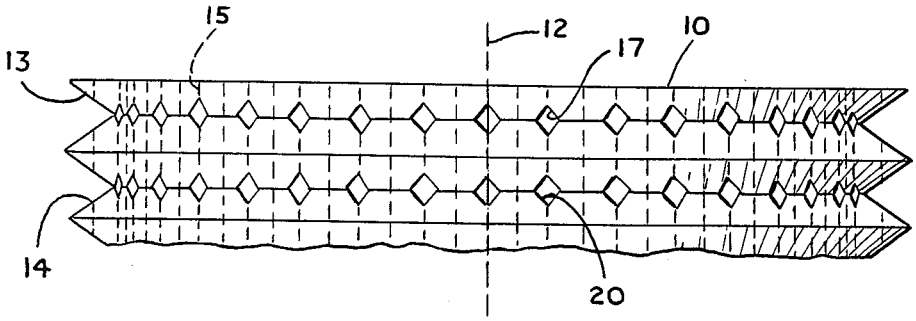
FIG. 1 is a side elevation of a portion of a fragmentation liner embodying features of the invention.

For a more thorough understanding of the invention attention is invited to FIG. 1 which shows a fragmentation ring 10 that has a cylindrical axis 12. In accordance with the invention, the outer circumference of the ring 10 has two circumferential, V-shaped concave grooves 13, 14 the depths of the grooves and the dimensions of the ring being selected to produce shrapnel, or fragments, of predetermined size and shape as described subsequently in more complete detail. At this point it should be further noted that the ring 10, is formed preferably from anodized aluminum to provide a lighter weight fragmentation casing that will burst into larger, low mass fragments.

Figure 2:
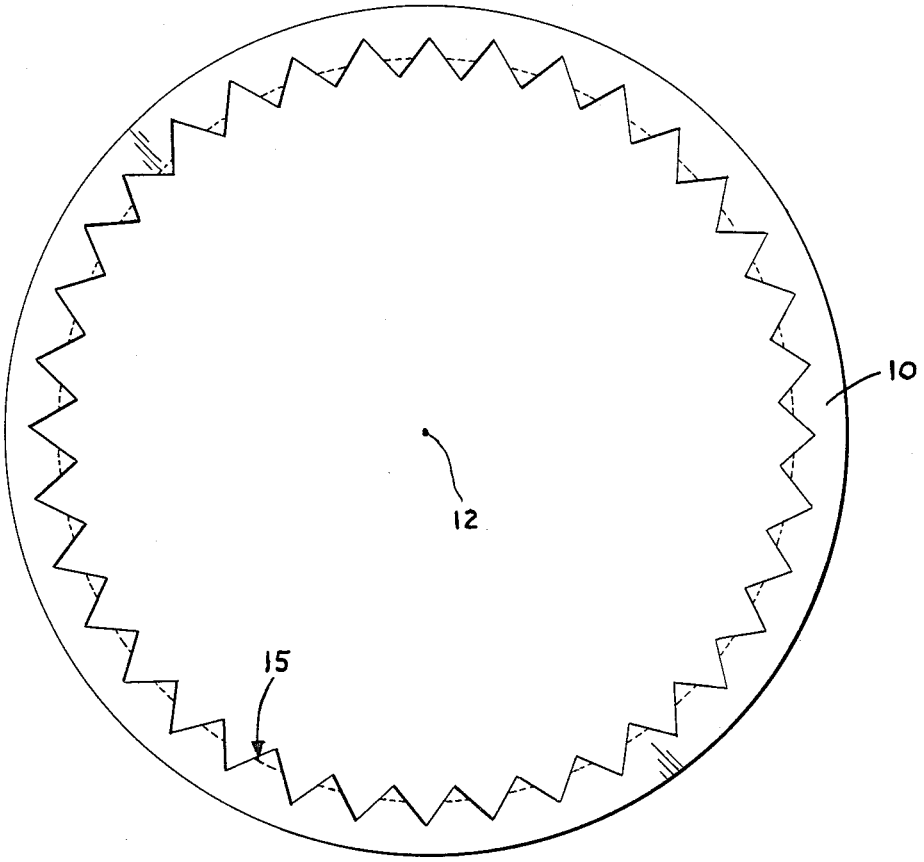
FIG. 2 is a plan view of the portion of the fragmentation liner that is shown in FIG. 1.

As best shown in FIG. 2, the ring 10 has an array of grooves 15 formed on its inner circumference. These individual grooves that form the array 15 also have V-shapes, each of which is generally perpendicular to the concave apex of the grooves 13, 14 in the outer circumference of the ring 10 (FIG. 1).

Figure 3:
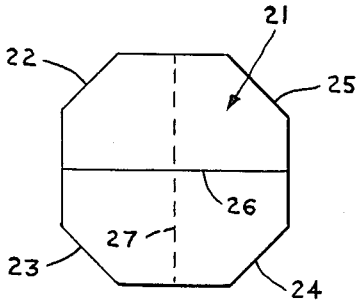
FIG. 3 is a typical fragment from the liner shown in FIGS. 1 and 2.

It will be recalled that the size, shape and distribution of the shrapnel created as the bursting charge (not shown in FIGS. 1 and 2) causes the ring 10 to fragment is controlled by the depths of the grooves 13, 14 and the grooves in the array 15, as well as the dimensions of the ring 10. Illustratively, the depths of the apices of the concave grooves 13, 14 at points of common intersection with the perpendicularly oriented grooves in the array 15 form diamond-shaped shrapnel apertures of which apertures 17, 20 are typical. These apertures 17, 20 not only permit the charge of bursting explosive to be loaded on either side of the ring 10, as described subsequently, but also define fragment size and shape by establishing the fragment corners. Thus, as the ring 10 bursts, the concave apices of the grooves that connect adjacent apertures form predetermined fracture lines to generate fragments of generally uniform size and shape. A typical fragment 21 is shown in FIG. 3. Note in FIG. 3 that the mass of the fragment 21 is determined by sides 22, 23, 24 and 25 of the apertures that defined its over-all size. The effectiveness of the fragment 21 is further enhanced by crests or creases 26, 27 on opposite sides of the fragment at the tops of the respective grooves from which the fragment is formed. In some circumstances, it also might be desirable to produce high stress concentrations at the creases 26, 27. Depending on the material selected for the fragmentation liner, these stress concentrations can be provided through heat treatment, of which rapid quenching after heating is typical.

As previously noted, the thickness and width of the ring 10 (FIG. 1), the depths of the grooves 13, 14 and the individual grooves in the array 15 determine the size and shape of the resulting fragments. In these circumstances, the fragments enjoy an unusual uniformity in shape and mass. Consequently, the dispersion pattern and the effective diameter of this pattern for any given munition is uniform and quite predictable.

The shapes and relative angular orientations of the grooves 13, 14 and grooves in the array 15 also can be varied to accommodate preferred machining operations, to produce particular bursting pattern, aerodynamic properties and the like. Thus, instead of the transverse grooves, 13, 14 formed in the outer periphery of the ring 10, one or more spiral grooves can be substituted. Similarly, the array of grooves 15 can be oriented at an acute angle relative to the grooves 13, 14, rather than the relative peripendicular orientation that is shown in the drawing.

As a further illustrative variant of the invention, concave transverse grooves can be formed on the inner circumference of the ring 10 and the concave, axially oriented grooves can be formed on the outer circumference of the ring 10.

Figure 4:
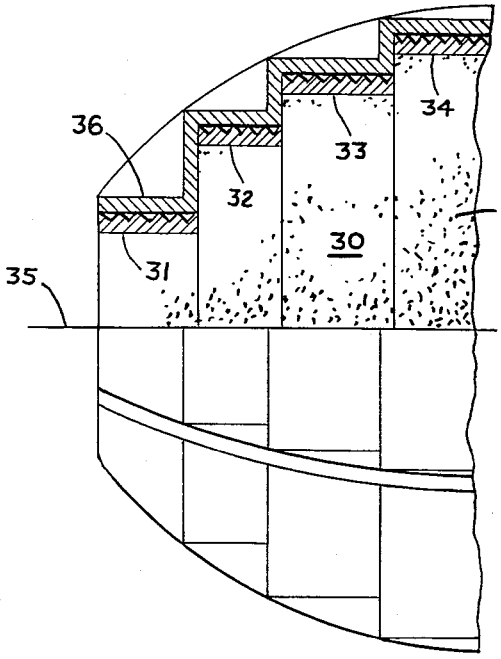
FIG. 4 is a side elevation in half section of a portion of a hand grenade fragmentation liner assembled in accordance with the invention.

Attention now is invited to FIG. 4 which shows a hand grenade fragmentation liner 30 assembled in accordance with principles of the invention. A group of rings 31, 32, 33, 34 each of which has a different diameter and are grooved in the manner described in connection with FIGS. 1 and 2, are aligned relative to longitudinal axis 35. The rings 31, 32, 33 34 are seated in mating recesses in an outer casing 36. The casing 36 has a stepped cylindrical configuration in order to accommodate the different diameters of the rings nested within and to impart to the grenade a general outline of the customary shape that is most suited to being grasped in a hand for aiming and throwing. The casing 36, moreover, can be formed of some sturdy, light weight plastic, or other suitable material in order to further reduce the overall weight of the grenade.

The apertures 17, 20 (shown in FIG. 1 and not shown in FIG. 4) provide communication between the inside of the repective rings 31, 32, 33 34 and the surface that is in contact with the outer casing 36. Thus, as the molten bursting charge (not shown in the drawing) is poured into the hollow cavity that is formed by the rings 31, 32, 33, 34, some of this charge flows through the apertures to fill the grooves in the outer circumferences of the respective rings. Upon bursting, the charge on both sides of the grooves explodes to produce a force resultant for each fragment that concentrates at the outer surface apex or crease further insuring disintegration of the liner 30 into individual fragments.

Figure 5:
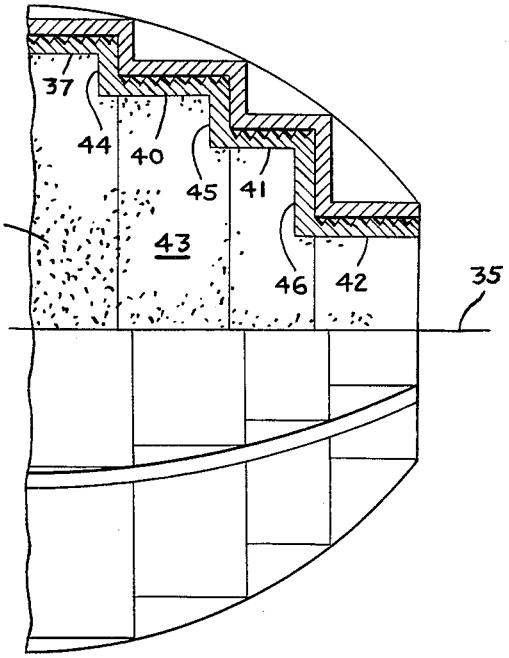
FIG. 5 is a side elevation in half section of a portion of a hand grenade liner that typifies a different embodiment of the invention.

A further embodiment of the invention is shown in FIG. 5. As illustrated, each of axially aligned and grooved rings 37, 40, 41 42 for a hand grenade fragmentation casing 43 are jointed each to a next adjacent ring by means of transversely disposed flanges 44, 45, 46. In this way a monolithic fragmentation casing is formed from the basic ring structures. Although the fragmentation liners shown in the drawing are assembled in stacked rings, a cylindrical or hexagonal liner, as well as any other suitable shape, can be used for the purpose of the invention which, as mentioned above, depends to a large extent on the forming of mutually intersection grooves of appropriate depths and cross sections on inner and outer fragmentation liner surfaces to provide suitable shrapnel.

It should be noted in connection with FIGS. 4 and 5, that the different diameters of the rings 31 to 34 and 37, and 40 to 42, respectively, to approximate the ovoid shape of a grenade without producing fragments of smaller size as the ends of the munition are approached.

Thus, there is provided in accordance with the invention a method and apparatus for forming the fragmentation casing for a munition. The technique shown and described produces lighter weight munitions of unimparied effectiveness in which the size, shape, mass and distribution pattern of the shrapnel can be controlled within much closer limits than those which heretofore were possible.

I claim:

1. A fragmentation liner comprising a ring having a plurality of grooves formed in the outer surface thereof and a plurality of grooves formed in the inner surface thereof, said inner surface grooves being angularly oriented with respect to said outer surface grooves to form mutual intersections therewith, and another ring stacked against said ring, said another ring having a plurality of grooves formed in the outer surface thereof and a plurality of grooves formed in the inner surface thereof, said inner surface grooves being angularly oriented with respect to said outer surface grooves to form mutual intersections therewith in order to form a fragmentation casing, all of said pluralities of grooves being sufficiently deep within said respective rings in order to form apertures at said mutual intersections to enhance liner disintegration into individual fragments.

2. A fragmentation liner according to claim 1 wherein said rings each have different diameters.

3. A fragmentation liner according to claim 2 wherein transverse flanges join said rings together at said adjacent stacked surfaces.

4. A fragmentation liner according to claim 2 wherein said rings are formed of anodized aluminum.

5. A hand grenade comprising a plurality of stacked rings, each of said rings having respective diameters that are different from the diameters of the adjacent rings in said stack, each of said rings having a plurality of grooves formed in the outer surface thereof and a plurality of angularly disposed grooves formed on the inner surface of each of said rings, said respective inner and outer grooves forming a plurality of mutual interactions therewith to produce a plurality of apertures at said intersections, and a bursting charge fill within said rings and in said outer grooves to enhance complete fragmentation of the grenade.

6. A structure for producing anti-personnel fragments comprising a liner, said liner having an inner surface and an outer surface, a plurality of grooves formed in the inner surface thereof, and a plurality of grooves formed in the outer surface thereof, said grooves being angularly oriented with respect to each other in order to establish a plurality of points of mutual intersection, said grooves being sufficiently deep to form an aperture in said liner at said mutual intersection points in order to produce an anti-persoinnel fragment of predetermined size and shape.

* * * * *